United States Patent [19]

Mendola

[11] 4,185,429

[45] Jan. 29, 1980

[54] APPARATUS FOR WATERPROOFING A BASEMENT OR SIMILAR STRUCTURE

[76] Inventor: Salvatore Mendola, 4 Rota Dr., Sayreville, N.J. 08859

[21] Appl. No.: 928,985

[22] Filed: Jul. 28, 1978

[51] Int. Cl.[2] ..... E04B 1/70; E04F 17/00

[52] U.S. Cl. ..... 52/274; 52/169.5; 52/287; 52/303; 52/741

[58] Field of Search ..... 52/169.5, 302, 303, 52/274, 287, 741; 405/43, 46, 48; 404/2, 4, 5,

[56] References Cited

U.S. PATENT DOCUMENTS

| | | | |
|---|---|---|---|
| 1,656,636 | 1/1928 | Hoffman | 52/302 |
| 2,147,035 | 2/1939 | Henderson | 52/303 X |
| 2,174,035 | 9/1939 | Henderson | 404/4 |
| 2,436,593 | 2/1948 | Moselowitz | 404/4 |
| 2,703,002 | 3/1955 | Suskind | 52/302 |
| 3,017,722 | 1/1962 | Smith | 52/169.5 |
| 3,287,866 | 11/1966 | Bevilacqua | 52/169.5 |
| 3,426,487 | 2/1969 | Forte | 52/169.5 X |
| 3,613,323 | 10/1971 | Hreha | 52/169.5 |
| 3,852,925 | 12/1974 | Gazzo | 52/169.5 |
| 3,975,467 | 8/1976 | Beck | 52/303 |
| 4,045,964 | 9/1977 | Barclay | 52/169.5 X |
| 4,075,800 | 2/1978 | Molick | 52/169.5 |

*Primary Examiner*—Alfred C. Perham
*Attorney, Agent, or Firm*—Arthur L. Plevy

[57] ABSTRACT

A drainage system is located in a trench formed about the inner periphery of a foundation. The drainage system comprises a plurality of interconnected pipes, each positioned and pitched to allow water entering the pipes to flow to a collection site. The pipes comprise a longitudinal tubular member having a top wall with a central section containing a plurality of apertures. The top wall has a first sloping section which slopes from one end towards the central portion at a given angle and slopes from the other end towards the central portion at the same angle to enable any water directed on the top surface to flow into the apertures on the central portion of the pipe. The member contains a bottom wall and first and second side walls. A first side wall has a plurality of apertures and is positioned against the foundation wall. The second side wall is devoid of apertures as is the bottom wall. The side walls are each of the same height. When the member is positioned within the trench, the apertures in the top surface and the side wall in contact with the foundation wall cause water to flow through the pipe structure and to be directed towards the collection site.

10 Claims, 7 Drawing Figures

Fig. 1.
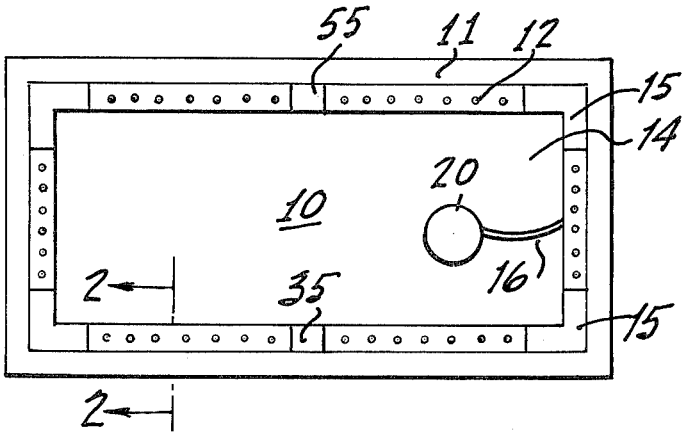
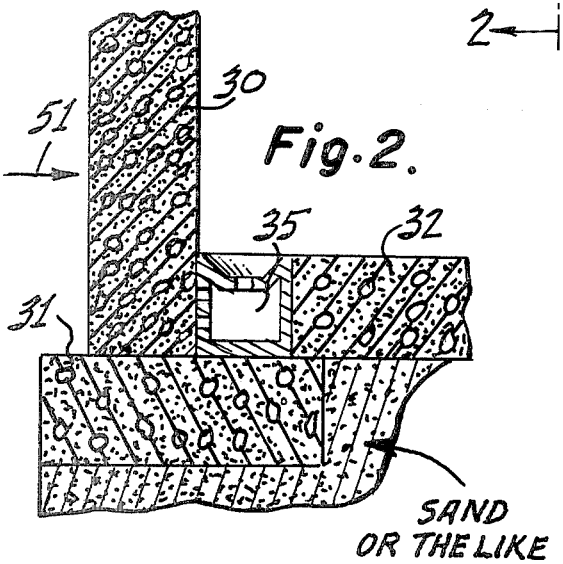
Fig. 2.
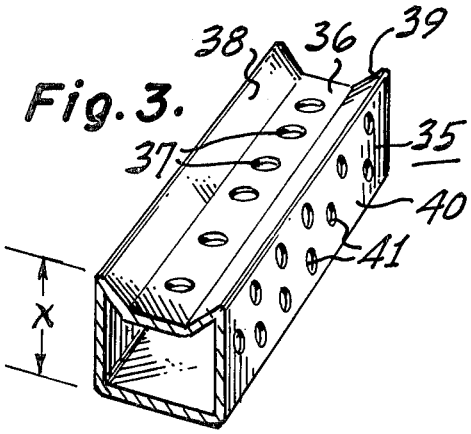
Fig. 3.
Fig. 4.
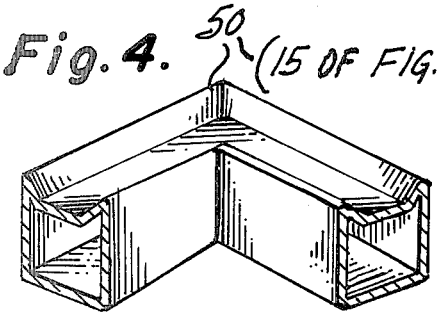
Fig. 5.
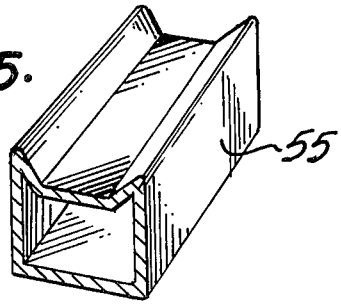
Fig. 6.
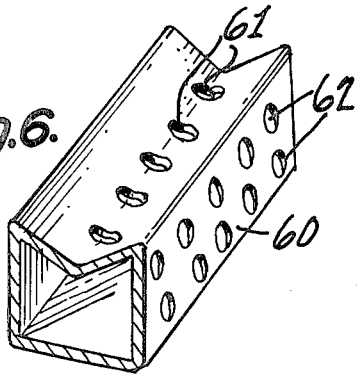
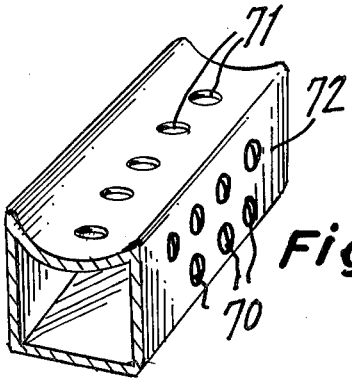
Fig. 7.

APPARATUS FOR WATERPROOFING A BASEMENT OR SIMILAR STRUCTURE

BACKGROUND OF INVENTION

This invention relates to a drainage system for waterproofing a foundation and more particularly to a drainage system to be used in conjunction with a foundation wall.

As is known, the problem of water entering a basement or foundation is caused by external cracks in the foundation wall or an increase in water pressure which can force the water through mortar joints and so on. Of course, the problem of water entering a basement can be extremely disconcerting and can cause a great deal of damage and injury to a home.

There are many approaches known in the prior art to attempt to prevent water from seeping into or entering a basement. One approach is to attempt to block or cover external holes to prevent water from seeping into the foundation. Other attempts involve the use of waterproofing compounds such as tars and epoxies which are used to coat the outside of the foundation wall to prevent water seepage.

In any event, the repair of such walls in an established home is extremely difficult as such repairs may require the removal of shrubs, sidewalks and so on. An attempt to repair the inside of a foundation wall is also difficult as such walls may be panelled, painted and hence, great sums of money are spent in attempting to repair and fix such foundations. The prior art was cognizant of such problems and there exists a number of patents in the prior art which attempt to provide drainage systems, which systems will reduce the possibility of water, which seeps into a foundation wall, from damaging the home.

Examples of such drainage systems can be had by referring to the following types of patents:

U.S. Pat. No. 3,287,866 entitled FOUNDATION AND WALL DRAINAGE SYSTEM issued on Nov. 29, 1976 shows a construction in a foundation wall which forms vertical drainage channels. The channels have openings which communicate with drain tile which is embedded in a gravel bed which is positioned beneath the foundation wall.

Other patents such as U.S. Pat. No. 3,426,487 entitled A BASEMENT DRAINAGE SYSTEM issued on Feb. 11, 1969 show a system for removing water from the basement which comprises a plurality of conduit means which are inserted in the wall from the inside. The system employs a pump which connects to the conduit. The conduit system is placed about the basement wall in locations which have cracks or fissures.

U.S. Pat. No. 3,613,323 issued on Oct. 19, 1971 shows a form and drain tile system wherein a number of units include an upper wall section and a lower wall section which are secured in an aligned position by a detachable connection. Drain tile or duct is formed integrally with the lower wall section and has a plurality of drain openings formed therein. The units are prestacked into the foundation wall as shown in the patent.

U.S. Pat. No. 3,852,925 issued on Dec. 10, 1974 shows a tile trench formed along the footing of a leaking wall. A tile is laid in the tile trench and drain openings are formed from the interior of the wall to provide connection with the drain tile. A granular material is placed over the drain tile and extends to the wall openings to provide a passageway. A plastic sheet is then placed over the granular material and a plurality of braces are positioned against the wall and the adjacent floor edges. Concrete is then poured over the braces and on the plastic sheet.

A further system is depicted in U.S. Pat. No. 4,045,964 issued on Sept. 6, 1977. This system shows a panel drain which consists of a prefabricated panel having a serpentine shaped cross-section. The cross-section which appears to be corrugated has a plurality of slots which pass through the panel. The panels can be placed along one foundation wall to form a drain curtain for transferring moisture to a drainage pipe.

Such patents as well as others specify complicated systems which are extremely difficult to fabricate and extremely difficult to install. Certain of the above described techniques involve substantial repairs and construction in an attempt to alleviate the problem and are not capable of being rapidly implemented and thus are difficult and expensive to utilize.

It is therefore an object of the present invention to provide a drainage system and apparatus for a basement or a foundation which effectively and efficiently removes seeping water before it can enter the useable basement space. The system to be described is capable of rapid installation and is easily adaptable to different basement structures and designs and in fact, can be installed together with the fabrication of the foundation to thus prevent water from damaging the home when completed. The system is also capable of being installed in established homes and can be done simply and effectively at a great savings in cost and labor.

BRIEF DESCRIPTION OF PREFERRED EMBODIMENT

A drainage system for a foundation, comprising a basement wall extending along a basement floor, a trench extending along the inner periphery of said wall and located between said wall and said floor, a first longitudinal tubular member positioned in said trench, said member having a top wall, a bottom wall and first and second side walls, with said top wall having a central region containing a plurality of apertures, with said central region communicating with the edges of said top wall by first and second sloping portions to enable water directed on said top wall to flow towards said central region and only said first side wall having a plurality of apertures with said first side wall positioned in abutting relation with said basement wall, said tubular member as positioned in said trench being sloped to cause any water entering the hollow confines of said member via said apertures in either said top surface or said side walls to flow towards a collection site.

BRIEF DESCRIPTION OF FIGURES

FIG. 1 is a top plan view depicting a typical foundation wall having a drainage system about the inner periphery according to this invention.

FIG. 2 is a cross-sectional view taken through line 2—2 of FIG. 1.

FIG. 3 is a perspective view of a pipe section which can be employed as part of the drainage system.

FIG. 4 is a perspective view of an elbow connector used in the drainage system.

FIG. 5 is a perspective view of a connector for joining together different pipe lengths.

FIG. 6 is a perspective view of another embodiment of a drainage pipe.

FIG. 7 is a perspective view of still another embodiment of a drainage pipe.

DETAILED DESCRIPTION OF FIGURES

Referring to FIG. 1, there is shown a top view of a typical basement or foundation assembly 10. Essentially, a foundation may be formed of poured concrete or cinder blocks which rest upon suitable footings. The purposes of the foundation is, of course, to support the walls of the home as is well known.

The foundation depicted conventionally consists of a rectangular configuration having front, back and side walls as is conventional. The back wall has been designated by the reference numeral 11 for purpose of this explanation. The foundation 10 is constructed in a well known and conventional manner and techniques for pouring and fabricating such foundations from concrete or other materials are well known in the art.

Shown located about the inner periphery of the foundation 11 is a drainage system 12 according to this invention. Essentially, the drainage system 12 is located between the foundation wall 11 and the basement floor 14. The drainage system 12 consists of a series of tubular plastic pipes which are positioned in a channel formed between the basement floor and the foundation wall. The pipes 12 are positioned prior to the formation of the foundation or may be located within a channel fabricated in an established home by removing concrete about the inner periphery of the basement wall as depicted in FIG. 1.

The plastic pipes 12 which comprise the drainage system are coupled together at each end by the elbow shaped coupling sections 15. Essentially, the pipes are fabricated from a plastic material such as a vinyl, acrylic or other type of plastic material and are extremely light, rugged and easy to handle.

If one employed the drainage system 12 in conjunction with a new foundation, the pipes are canted or pitched as positioned so that they are at a slight angle with respect to the basement floor to facilitate the flow of water towards a central drain 20 or to a sump pump or dry well location. Such techniques for pitching or angling foundations as well as pipe configurations are well known in the art.

Referring to FIG. 2, there is shown a cross-sectional view taken through line 2—2 of FIG. 1. A foundation wall 30 is shown. The wall 30 conventionally consists of either a poured concrete foundation or may consist of a plurality of cinder blocks or building blocks which are connected together by means of mortar or cement joints. The wall 30 rests upon a footing 31, which footing conventionally supports both the wall 30 and the concrete floor 32.

As seen in FIG. 2, a plastic pipe 35 is positioned on the footing and located between the wall 30 and concrete floor 32. The pipe 35 is of a general rectangular configuration, but has a recessed top surface. The top surface of the pipe 35 contains a plurality of aligned apertures to allow any water to be directed into the internal hollow of the pipe 35. The side wall of the pipe 35 which abuts the wall 30 has a plurality of apertures on the surface thereof. These apertures also cause water to be directed into the pipe 35. The bottom wall of the pipe 35 contains no apertures and the side wall which faces the basement floor 32 is also devoid of apertures. Hence, any water which may seep down wall 30 or through wall 30 from the outside designated by arrow 51 will enter the apertures in the side wall or top wall of member 35 and be directed within the internal cavity of member 35.

Thus, as can be seen from FIG. 1, all water which enters the drainage system 12 as via a pipe 35 of FIG. 2, will be directed to a trap or sump location where it will be discharged or removed. The system thus prevents water from entering into the useable portion of the basement or from being directed upon the basement floor.

It is also noted that the arrangement described above produces a highly aesthetic appearance, while further preventing water from seeping into the basement.

Referring to FIG. 3, there is shown a perspective view of a suitable section of pipe which can be employed about the periphery of a foundation and as pipe 35 depicted in FIG. 2. Essentially, as seen from FIG. 3, the pipe section 35 is of a rectangular configuration and is approximately two inches in width. The pipe shown has a general M shaped cross-section. The height X as shown is approximately between three and four inches, depending upon the thickness of the concrete floor. As shown in FIG. 2, the floor 32 is poured to a level approximately equal to the height X of the side wall of the member 35.

The member 35 as shown in FIG. 3 possesses a central region 36 which has located thereon, a plurality of equally spaced apertures as 37. The side walls 38 and 39 have the top surface of the member 35 sloping towards the central region 36 at a sufficient angle to cause any water to flow into the apertures 37 of the central region 36. The top surface with apertures 37 is positioned as shown in FIG. 2.

One side wall as 40 contains a plurality of apertures which may be randomly or uniformly disposed on the surface. These apertures as 41 are only located on the side wall 40 which is the side wall which abuts against the foundation wall 30. In this manner, any water which seeps down the foundation wall will enter the apertures 41 and be directed through the pipe 35 to the discharging location 20.

Referring to FIG. 4, there is shown a suitable elbow coupling mechanism 50. Essentially, the member 50 consists of a right angle elbow having the same cross-sectional configuration as the pipe 35. It is, of course, understood that this coupling device enables one to couple a length of pipe 35 to another similar configuration to enable a right angle bend such as those formed at the corner of the foundation. It will be apparent that any other angle can be formed by the use of similar coupling structures to enable the accommodation of any other type of bend or angle which may exist in a foundation.

Due to the nature of the pipe as being fabricated from plastic, the pipes can be inserted into the member 50 and if desired, the joints can be sealed by means of a suitable epoxy or a sealing compound; may examples of which are well known in the art.

In a similar manner, the pipe 35 can be of sufficient lengths to accommodate a particular foundation or various sections of pipe can be joined together as desired to accommodate any length. Typical joining members may include a slightly larger section of pipe having the same cross-sectional configuration as that shown in FIG. 3 and as depicted in FIG. 4. A joining member to couple sections of pipe together is seen in FIG. 5 as 55 and may comprise a short length of a pipe having the same cross-sections as pipe 35 of FIG. 3 and used to couple two lengths of pipe together in a horizontal direction.

Thus, as above described, a pipe 35 is shown which has a central portion on a top surface containing a plurality of apertures. The side walls of the pipe at the top surface slope towards the central portion to thereby allow water to be directed to the central portion. If water is collected on the top surface, the side wall which faces the foundation wall 30 contains a plurality of apertures as 40 to further direct water into the hollow confines of the tubular pipe section 35. It is again noted that the bottom surface and one side wall do not contain apertures and hence, water cannot enter in through the bottom or through one side.

It is further noted that the bottom wall as shown in FIG. 3 may be slightly sloped from the side wall which contains the apertures to the opposite side wall. In this manner, any water entering into the pipe 35 will be directed along the side wall and the bottom wall, both of which contain no apertures. Due to the nature of the plastic material of which the pipe is fabricated and due to the slight taper of the bottom wall, water entering the hollow confines of the pipe will be forced to accumulate between the side and bottom walls.

As indicated in conjunction with FIG. 1, the pipes as 12 which form the drainage system are sloped or pitched when inserted in the trenches about the periphery of the foundation to cause water to flow towards the trap or collection site 20. The water is directed thereto by means of a pipe 16 by forming a hole in the bottom of a pipe such as 35 of FIG. 3.

Referring to FIG. 6, there is shown an alternate configuration of a pipe 60 which may be employed in lieu of the pipe 35 shown in FIG. 3. The pipe 60 has a top surface of a V cross-section so that water can again be directed towards the apertures 61 which are formed at the central portion of the top surface or at the point where the sloping sides of the top surface meet. Again, one side wall contains a plurality of apertures as 62 and this side is placed against the foundation wall. As can be seen from FIG. 6, the pipe configuration 60 functions similarly to the configuration depicted in FIG. 3.

FIG. 7 shows another configuration of a pipe 70 wherein the top surface is of an arcuate configuration having holes 71 located at the central portion of a side wall containing apertures 72 which again is positioned against the foundation wall.

From the above descriptions, it should be apparent to one in the art on how coupling members such as shown in FIGS. 4 and 5 can be implemented to accommodate pipe configurations as depicted in FIGS. 6 and 7 and hence, one can ascertain how a drainage system can be implemented by interconnecting the various members together about a peripheral trench formed around the inner periphery of the foundation wall.

It is, of couse, understood that various other modifications and configurations can be utilized without departing from the spirit and scope of this invention as will be defined by the breadth and scope of the claims appended hereto.

I claim:

1. A drainage system for a foundation, comprising:

(a) a basement wall extending along a basement floor, (b) a trench extending along the inner periphery of said wall and located between said wall and said floor, (c) a first unitary longitudinal tubular member positioned in said trench, said member having a top wall, a bottom wall and first and second side walls, with said top wall having a central region containing a plurality of apertures, with said central region communicating with the edges of said top wall by first and second sloping portions to enable water directed on said top wall to flow towards said central region and only said first side wall having a plurality of apertures with said first side wall positioned in abutting relation with said basement wall, said tubular member as positioned in said trench being sloped to cause any water entering the hollow confines of said member via said apertures in either said top surface or said side walls to flow towards a collection site.

2. The drainage system according to claim 1 wherein said longitudinal tubular member is fabricated from plastic.

3. The drainage system according to claim 1 wherein said top surface of said tubular member is of a "V" cross-section, with said apertures positioned at the bottom central portion of said "V".

4. The drainage system according to claim 1 wherein said top surface of said tubular member is of a "U" shaped cross-section with said apertures positioned at the base of said "U" defining a central region.

5. The drainage system according to claim 1 wherein said top surface of said tubular member comprises a flat planar region centrally located and having a plurality of apertures positioned thereon, with a right side sloping downwardly towards said central region from a first edge and a left side sloping downwardly towards said central region from a second edge.

6. The drainage system according to claim 1 wherein said bottom wall is at a slight angle with respect to said first side wall to cause water entering the apertures in said first said wall to be directed towards said second side wall.

7. The drainage system according to claim 1 including a second longitudinal tubular member of an exact configuration as said first tubular member, and means for coupling said first and second members together.

8. The drainage system according to claim 1 wherein said side walls are of a height between two to three inches.

9. A method of providing a drainage system for a foundation, comprising the steps of:

(a) forming a trench about the inner periphery of the foundation wall, (b) inserting a plurality of longitudinal tubular members within said trench and about said periphery of said inner wall, said members having a top surface of a recessed configuration to cause water to flow towards the center of said top surface, (c) forming a series of apertures in the center of said top surface of said tubular member, (d) forming a plurality of apertures on a side wall of said tubular member; which side wall is in abutting relation with said foundation wall, (e) sloping said tubular members towards a collection site whereby any water entering said apertures is directed to flow via the hollow confines of said tubular members towards said collection site.

10. The method according to claim 9 wherein said tubular members are fabricated from plastic.

* * * * *